US005975529A

United States Patent [19]

de Keller

[11] Patent Number: 5,975,529

[45] Date of Patent: Nov. 2, 1999

[54] CASINO POKER GAME

[76] Inventor: David Guy de Keller, Sweet Valley Farm, Soetvlei Ave, Constantia 7800 Cape Town, South Africa

[21] Appl. No.: 08/526,382

[22] Filed: Sep. 11, 1995

[51] Int. Cl.[6] ..... A63F 1/00

[52] U.S. Cl. ..... 273/292; 463/26; 463/27

[58] Field of Search ..... 273/292, 274; 463/26, 27

[56] References Cited

U.S. PATENT DOCUMENTS

| | | | |
|---|---|---|---|
| 5,257,789 | 11/1993 | Le Vasseur | 273/292 X |
| 5,382,025 | 1/1995 | Sklansky et al. | 273/292 |
| 5,397,128 | 3/1995 | Hesse et al. | 273/292 |
| 5,407,208 | 4/1995 | Keller et al. | 273/292 X |
| 5,417,430 | 5/1995 | Breeding | 273/292 |
| 5,423,551 | 6/1995 | Stavinsky | 273/292 X |
| 5,494,295 | 2/1996 | Potter et al. | 273/292 |
| 5,540,444 | 7/1996 | Nguyen | 273/292 |
| 5,556,101 | 9/1996 | Jabro | 273/274 |

FOREIGN PATENT DOCUMENTS

| | | | |
|---|---|---|---|
| 9216269 | 10/1992 | WIPO | 273/292 |

*Primary Examiner*—William E. Stoll
*Attorney, Agent, or Firm*—Quirk & Tratos

[57] ABSTRACT

A casino game comprising one or more decks of standard playing cards and a layout which designates a first area for the placing of two to five community cards and a second area composed of a plurality of betting areas. The object of the game being to make a good poker hand with the advantage of discarding and being dealt replacements, such poker hand of 5 cards being composed of players' individual cards in conjunction with the community cards. A further object of the game is to win the Pot Bets by holding the highest poker hand. The preferred game apparatus includes a single deck of standard playing cards and a layout that provides betting areas 5, 6, 7 & 8 for placing counters.

14 Claims, 2 Drawing Sheets

CASINO POKER GAME

The present invention relates to improvements in playing the traditional game of poker; a layout/game board is provided and one or more decks of conventional playing cards, as is commonly used in casinos, is utilised.

BACKGROUND OF THE INVENTION

Poker is a popular game throughout the world. It combines principles of card games known for centuries in Europe but in it's present form it is distinctly of American origin. There are numerous forms of poker and the main divisions are: Draw Poker, in which all of a player's cards are unknown to his opponents; and Stud Poker, in which some of a player's cards are face up and others face down.

In modern casinos the game of poker takes one of three forms: 'live' poker where players compete against one another but the games are controlled and supervised by a house dealer—the games are not a contest between the players and the casino—and the casino imposes a levy either in the form of a participation fee or as a percentage of winning hands; electronic video style machines offering Draw Poker; and poker played as a bankers game either where the game involves players in contest with the dealer's hand or where the object is for the players to obtain a good poker hand, in both cases the paytable is structured in such a way that the pay-offs are not based on the true mathematical odds thereby resulting in the casinos enjoying a favourable advantage.

The present invention named Showdown Poker, marries the principles of 'live' poker and poker played as a banker's game; players compete against one another and they play against the house in that the pay-offs on some of the wagers give the house a favourable edge. The present invention combines the two basic forms of poker; Showdown Poker is a blend of Draw Poker and Stud Poker wherein players receive cards, the identity of which is unknown to one another and which they may discard and in return receive replacements face-down and each player's hand is partly composed of community cards, one or more of which are face up.

In essence Showdown Poker introduces new features and structures not found in any of the three forms of poker found in casinos. The game of Showdown is innovative in that no other casino game in the United States or elsewhere is structured whereby players are offered both the option of discarding and a Pot Bet which is a bet solely between the players and where the house is not in contest with the players.

Despite the fact that the principle of using cards or other means as a result selector in a board game to constitute a game of chance and/or skill is well established, room exists for the improvement of such games and for devising new layout designs coupled with the modification, adaptation and innovation of conventional structures of play. This principle is accepted by the U.S. Patent & Trademark Office and is exemplified by the granting of Patents to inter alia:

| | | |
|---|---|---|
| McKeever | No. 2,712,446 | July 5 1955; |
| De Keller | No. 3,693,977 | Sept 26 1972 |
| Monek | No. 3,826,498 | July 30 1974 |
| Berman | No. 4,902,019 | Feb 20 1990 |
| Page | No. 5,133,559 | July 28 1992. |

The principle objective of the present invention is to provide a gaming layout arrangement and set of structures and rules of play which effectively blends the old and new in casino poker whereby a game is produced which is a balanced mixture of skill and chance and which is both easy to operate and easy for players to understand. In the past 'table games' generated a larger volume of money wagered than slot machines. The picture has changed in recent years and today slot machines account for a higher revenue than traditional table games. This situation has arisen for a number of reasons. Innovation in design and technology have made slot machines more exciting and the jackpot element in slots has grown into mammoth payouts. As a consequence of the above situation casino owners are receptive to the introduction of new table games in order to revive the aura and excitement of live gaming. Showdown poker is a game designed to achieve the above objective.

Various other objects and advantages of the present invention will become clear from the detailed description of an exemplary embodiment thereof and the novel features will be particularly apparent in the accompanying drawings in conjunction with the appended claims.

DISCLOSURE OF THE INVENTION

This invention is based on the game of poker and comprises apparatus for playing a casino game wherein elements of skill and chance are blended. The apparatus consists of a playing surface/layout (cloth, table top or game board) and a result selector in the form of a single deck of conventional playing cards, as is commonly used in casinos; the layout being marked out with a first area constituted by at least two or more areas, in the form of rectangles, squares or other geometric shapes, situated directly in front of the dealer, such demarcated areas being for the placing of community cards numbering from two to five.

A second area on the layout designates betting areas for the reception of players' chips. Indicia in the shape of horseshoe symbols, situated in the front of each player, bear numerals to signify the number of wagers the players make in the course of a round of the game. These numbered betting areas number from two to six per player but in the preferred embodiment of the game three areas representing three separate wagers will be the case. The betting areas may appear in the from of geometric shapes. Directly in front of each player is positioned a depiction of a Pot, labelled 'Pot Luck', which designates a specific type of wager. In Showdown Poker the object of the game is twofold:

a) to make a good poker hand and b) to win the Pot bets.

In the case of 'a' the house payout schedule lists a series of poker rankings with corresponding pay-offs and in the case of 'b' the player with the highest poker hand showing wins the Pot bets. FIG. 2. The Pot bet is a bet solely between the players. It is not a wager played against the house.

The game is played on a blackjack style table with a single dealer. One or more decks of standard playing cards are used, the preferred embodiment being one. The player opening the betting is rotated for each game. The game is played with chips/counters of various denominations. At the start of each game all players place a bet of equal value in their respective pots. Players then place Bet 1 (the maximum and minimum value thereof being determined by the house) and each player is dealt two cards (this number may vary), face-down, and the dealer receives three cards (this number may vary) one face-up and two face-down. The three dealer's cards are community cards, referred to as the 'flop' and complete each player's hand. The players, at this stage know the identity of three cards and each player has the option of discarding their first or second card, or both, face down. Replacements, face-down are received for discards. Players may at this stage, either 'stand' by making no further bets or 'raise' by wagering on Bet 2. The Bet 2 wager must be exactly equal in value to the amount wagered on Bet 1. When all wagers have been placed on Bet 2 the fourth card is revealed by the dealer. Players may again either stand at this stage or raise by wagering on Bet 3. Players are not permitted to make a third bet if they have not placed the second. The Bet 3 wager must be exactly equal in value to the amount wagered on Bet 1. When all third bets have been placed the dealer turns up the fifth card. Each player reveals his/her cards and provided they show a winning hand on the list of poker rankings hands are paid according to the total stake placed at the corresponding pay-offs/odds. Table A—The player with the highest* poker hand is awarded all the Pot bets; in the event of players holding identical hands the Pot is shared. No matter how many cards constitute community cards or how many cards are dealt to each player, the players select five cards to make up their hands.

DESCRIPTION OF THE DRAWINGS

A preferred gaming table and layout in accordance with the present invention is illustrated in the drawings wherein.

DETAILED DESCRIPTION OF THE INVENTION

In a preferred embodiment of the present invention a gaming layout is provided having a surface marked out as illustrated in FIG. 1*a*, together with a single deck of standard playing cards as is commonly used in casinos.

The cards used in the game are conventional playing cards divided into four sets of thirteen cards per set and each set constitutes a suit identified by separate indicia in the form of hearts, spades, diamonds and clubs. Each set in turn has nine cards bearing the numerals 2 to 10 and four court cards represented by either the letters A, K, Q & J or the titles Ace, King, Queen and Jack or pictorial representations or symbols thereof. Designs of modern court cards may differ but all are generally stylizations of stylizations and have their roots in the Tarot pack of medieval times.

Figure 1:
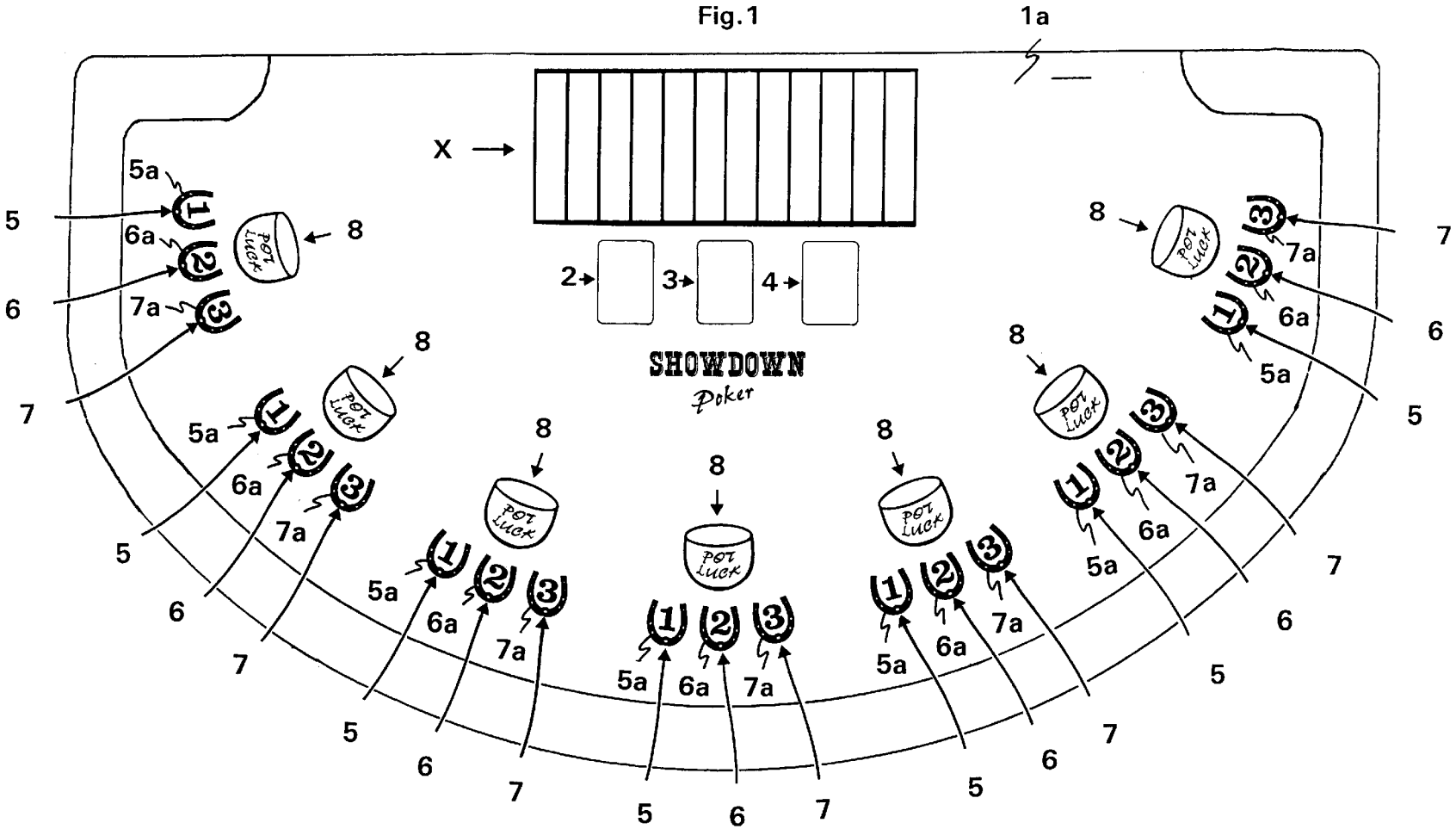
FIG. 1. is a top plan view of the gaming table and layout; a first area marked 2, 3 & 4 constitutes the spaces for positioning the community cards; a second area comprising a series of betting areas, positioned opposite each player station, such betting areas being identical in form to one another.

Referring to the drawings the table is two legged in a half-moon shape 1 and has a flat playing surface 1*a* FIG. 1. The actual form of such a table (whether semi-circular, square etc.) is of no importance, the table mainly serving to support the layout at a height which is suitable for the players. The area marked X on FIG. 1 is an area for housing the chips/counters prior to being used by the players. The layout 1*a* provides a playing surface marked with indicia 2, 3 & 4 to define the areas wherein the community cards are positioned by the dealer. A second area on the layout designates betting areas for the reception of players' chips such betting areas bearing indicia in the form of horseshoe symbols, situated in front of each player, and each such area 5, 6 & 7 is further identified by numerals 1, 2 & 3 to signify the numbers of wagers the players make in the course of a round of the game. These numbered betting areas 5, 6 & 7 can number from two to six per player but in the preferred embodiment of the game three areas representing three separate wagers will be the case. The betting areas 5, 6 & 7 need not be stylised in the form of an horseshoe and can be in the form of geometric shapes.

Directly in front of each player post is positioned a depiction of a Pot 8, labelled 'Pot Luck' 8*a*, which designates a specific type of wager. In Showdown Poker the object of the game is twofold:

1) to make a good poker hand using two cards and the three community cards.

2) to win the Pot bets.

Figure 2:
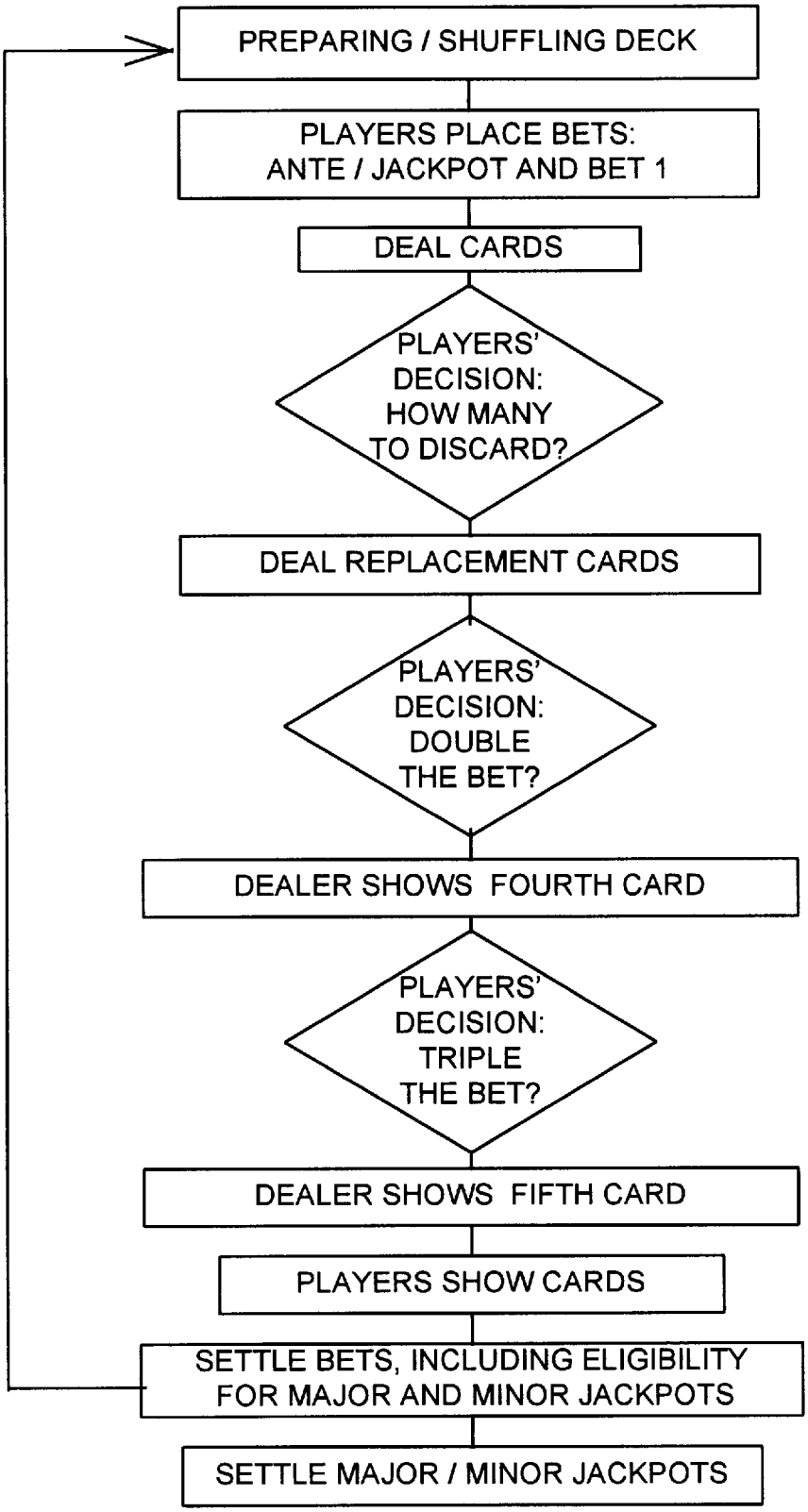
FIG. 2. is an illustration of the hierachical ranking of poker hands utilising standard playing cards as are commonly used in casinos.

In the case of 1) above the house payment schedule lists a series of poker hands with corresponding pay-offs which apply to Bets 5, 6 & 7. In the case of 2) above, the player with the highest poker hand showing wins the Pot Bets 8. FIG. 2 The Pot bet 8 is a bet solely between the players and does not involve a wager against the house. FIG 1*a*.

The Play

At the start of each game and prior to receiving cards all players place a chip(s) in their Pots 8 and wager a chip(s) on Bet One 5.

The dealer shuffles the cards FIG. 2 and places one card face down in the area on the layout marked 4 and deals each player one card face down. The dealer then places a second card face-down in the area marked 3 and deals the players a second card face-down and concludes the round by placing a third card face-up in the area marked 2. The three cards in the areas 2, 3 & 4 are community cards and complete each players' five card hand. FIG 1*a*, Each player has the option of discarding their first or second card, or both, face down. Players may at this stage, either 'stand' by making no further bets or 'raise' by wagering on Bet Two 6. When all wagers have been placed on Bet Two 6 the fourth card is revealed by the dealer. Players may again either stand at this stage or raise by wagering on Bet Three 7.

The game Showdown is not limited to the above description/procedure with a deal relating to five cards per player. The deal can be composed of five to ten cards divided between the community cards and the cards each player receives but in each case a player would still select five cards to constitute his hand. A further variation of the deal consists in changing the mix of the number of cards dealt to the players and those that constitute the community cards. An example of a deal using seven cards and altering the mix of both the community cards and the players' cards would be where each player received three cards (two cards face-down and one face-up), and the community cards (the Flop) would comprise four cards, one face-up and three face-down.

Referring to the preferred embodiment of the game exemplified in the layout FIG 1*a*, Table A illustrates the pay-offs in relation to the list of poker rankings applicable to the game. The house advantage is achieved because a difference exists between the true mathematical odds and the actual pay-off ratios. Table B is a flow chart illustrating the basis of the calculations. The game can be played by offering odds/pay-offs of a higher or lower order resulting in different edges accruing to the house.

The house advantage in the majority of live/table games played in casinos is based on a fixed percentage e.g. roulette played with a double zero has a house edge of 5.4%. Showdown Poker is structured like the casino game Blackjack where in both cases the house edge is dependent on the skill displayed by individual players. A player who bases his play on optimum strategy in Showdown, will at worst, be up against a house advantage of 1.2% i.e. the difference between the pay-offs he would receive on winning hands and the true long term mathematical odds in relation to those hands. Table C illustrates the principle of optimal strategy. The house edge will fluctuate according to the skill or lack of skill displayed by individual players.

The game is operable despite the addition or omission of specific wagers. An example of the addition of a wager, termed a Bonus Bet, which is an optional wager is one whereby, if the first three cards of a player's hand comprises one of a number of select combinations, he will receive specific pay-offs. In the above example applied to the preferred embodiment of the game, the combinations apply to the two cards dealt to a player and include the face-up community card. This wager applies to cards dealt and not to discards and replacements. The game can be played in a format featuring a progressive jackpot. Such a format would entail an optional wager made at the start of each game, the object to win one to five high combinations e.g. Royal Flush, Straight Flush etc; a proportion of each such bet would be automatically added to the running jackpot displayed on a win meter. Each table top is fitted with a coin detector slot which communicates electronically to the dealer control panel when a chip is inserted. Those players that qualify as winners are paid out according to the current jackpot pay-table. Co-winners share the jackpot as an aggregate.

Showdown Poker can be adapted and played on a video game machine. Simulated cards are exposed electronically on a display panel/screen. For the discarded cards random replacements are dealt from those remaining in the deck.

Procedure of play: the player inserts one to five coins in the machine and pushes a button marked 'deal'. Five cards appear on the panel/screen; on one row, marked 'Player' there are two cards, face-up; on the second row marked 'Flop' there are three cards, one face-up and two face-down. A player has the option of using his two cards or discarding one or both. He discards by pushing a button marked 'Discard' situated beneath each card. In order to see the fourth card the player pushes a button marked BET 1. To see the fifth card the player pushes a button marked BET 2. A player can decide to stop betting at any time after the deal by pushing a button marked 'Game Over'. A player, irrespective of 'standing' after the deal or after BET 1 will be paid a winning hand according to the number of coins bet. All pay-offs include the return of the player's wagers and are multiplied by the number of coins bet. The pay-offs on a video styled machine like the table game, are based on traditional poker rankings.

Different rules for playing the game can be applied. The game is operable without the option of discarding; a joker can be introduced to the pack of cards. In the above two examples the pay-table will be adjusted to reflect the probabilities. It is to be understood that the embodiment discussed herein is merely illustrative of the application of the principles of the invention. Numerous modifications may be made therein and other arrangements may be devised without departing from the spirit and scope of the invention.

What is claimed is:

1. A method of playing a card game comprising the steps of:

requiring each player to place a first wager to participate in a wagering game played against the house/bank; and requiring each player to place an additional bet of equal value into a pot/pool; the pot constituting a communal wager or pool wherein the players compete not against the bank but against one another with the winner of the pot bets being the player holding the highest poker hand of five cards; dealing a predetermined number of cards to each player;

dealing a predetermined number of communal cards;

allowing each player the option of discarding all or some of their noncommunal cards and receiving replacements;

a comparison being made between each players five card hand, such hand partly composed of individually dealt cards in conjunction with the communal cards, using poker rank both as the criterion for determining winning hands against the bank and for determining the winning hand regarding the pot bets; and paying each winning player odds displayed by the house paytable depending upon the poker rank held by each winning player;

awarding all pot wagers to the player holding the highest poker ranked hand.

2. The game according to claim 1, wherein said first game participation wager is a wager against the bank and said pot bet comprises a contest between players and not against the bank.

3. The method of claim 1, wherein said predetermined number of cards dealt to each player numbers two dealt face-down.

4. The method of claim 1, wherein said predetermined number of communal cards consist of three, two dealt face-down and one face-up.

5. The method of claim 1, wherein said predetermined number of cards dealt to each player numbers three, dealt face-down and wherein the number of communal cards consist of two, dealt face-down.

6. The game according to claim 1, wherein said first game participation wager can be duplicated by all players in a second bank wager.

7. The game and method according to claim 1, wherein said game participation wager can be triplicated by all players in a third game/bank wager provided that those players had duplicated their bets.

8. The method of play according to claim 1, wherein said bank participation wagers of an individual player must all be exactly equal in value; bets 2 and 3 must be exactly equal to the amount, whatsoever such amount is, wagered on bet 1.

9. The method according to claim 8, wherein said bank participation wagers 2 and 3 are not compulsory; players may 'fold' by confining their bank participation wagers to either the first bet or the second bet.

10. The method of playing a card game according to claim 1, comprising the steps of:

a dealer providing all players with either two or three cards dealt face-down;

each player placing a first wager to participate in a wagering game against the bank wherein players are wagering that their hands will result in one of a series of predetermined poker rankings;

each player placing an additional wager to participate in a pot bet constituting a bet between the players with the highest hand declared the winner of the potpooled bets;

the dealer providing a communal hand composed of either three cards, one face-up and two face-down or alternatively two cards face-down; the players having the option of discarding some or all of their individually dealt cards and receiving replacements;

the players having the option of placing a second bet in the game against the bank, the value of such second bet being exactly the same value as the first bet;

the dealer turning face-up a communal card;

the players having the option of placing a third wager in the game against the bank, provided that the player had placed a second wager, the value of such third bet being exactly the same value as the first bet; the dealer turning up the final communal card;

the dealer comparing each player's hand, composed of individually dealt cards in conjunction with the communal cards, using poker rank as the criterion to determine winning hands in the wagering game against the house and by using poker rank criterion to determine which player holds the highest hand vis-a-vis the pot bets.

11. A method of playing the game according to claim 1 or claim 4, further comprising the step of dealing two additional communal cards face-down; allowing players to place two further consecutive wagers, each wager of an individual player being equal in value to the amount wagered in the first bank participation wager and providing players had placed the preceding consecutive wagers.

12. A method of playing a game according to claim 1 or claim 5, further comprising the step of dealing two additional communal cards face-down; allowing players to place two further consecutive wagers, each wager of an individual player being equal in value to the amount wagered on the first bank participation wager and provided that players had placed all the proceeding consecutive wagers.

13. The method of claim 1, including a progressive jackpot wager associated with said game and comprising the steps of:

requiring each player to participate in said jackpot wherein said jackpot is combined with the pot bet; and wherein said jackpot is divided into;

a major jackpot based on a hand, comprising a predetermined arrangement of cards, termed a Royal Flush;

the winner of the major jackpot being awarded the current amount displayed on the win meter and in addition being awarded all the pot bets; and a minor jackpot based on a predetermined arrangement of cards wherein a player holding a hand composed of Two Aces and Three of a Kind in the same round of play as a player holding a higher hand, the minor jackpot being awarded to the lower hand, such player receiving 50% of the minor jackpot total, 25% of the total being awarded to the player with the higher hand and the balance of the minor jackpot total being shared equally by all the players in that particular round of play;

in all instances, bar the event of the minor jackpot occurring, the player with the highest poker ranked hand being awarded the pot bets.

14. The method of claim 1 wherein said bank wager is combined with the pot wager; and wherein a jackpot is divided into;

a major jackpot based on a hand comprising a predetermined arrangement of cards termed a royal flush;

the winner of the major jackpot being awarded 50% of the current amount displayed on the jackpot meter and in addition being awarded the pot bets; and 50% of the current amount displayed on the jackpot meter being awarded to all other participants in such round of play, on an equal basis; and minor jackpots both based on a predetermined arrangement of cards wherein a player holding a hand termed a straight flush is awarded 10% of the current amount displayed on the jackpot meter; and wherein a player holding a hand termed four of a kind is awarded a fixed amount;

in all instances of the jackpot and or minor jackpots occurring the player with the highest ranked hand being awarded the pot bets.

* * * * *